US010337249B2

(12) United States Patent
Hatfield

(10) Patent No.: US 10,337,249 B2
(45) Date of Patent: Jul. 2, 2019

(54) DRILLING WELLS WITH AIR

(71) Applicant: Jason A Hatfield, Marshallville, OH (US)

(72) Inventor: Jason A Hatfield, Marshallville, OH (US)

( * ) Notice: Subject to any disclaimer, the term of this patent is extended or adjusted under 35 U.S.C. 154(b) by 0 days.

(21) Appl. No.: 15/731,849

(22) Filed: Aug. 15, 2017

(65) Prior Publication Data

US 2018/0223613 A1 Aug. 9, 2018

Related U.S. Application Data

(60) Provisional application No. 62/499,713, filed on Feb. 4, 2017.

(51) Int. Cl.

| | |
|---|---|
| ***E21B 4/14*** | (2006.01) |
| ***E21B 21/16*** | (2006.01) |
| ***E21B 33/14*** | (2006.01) |
| ***E21B 21/12*** | (2006.01) |
| *E21B 33/03* | (2006.01) |

(52) U.S. Cl.

CPC ..... *E21B 4/14* (2013.01); *E21B 21/12* (2013.01); *E21B 21/16* (2013.01); *E21B 33/14* (2013.01); *E21B 33/03* (2013.01)

(58) Field of Classification Search

None

See application file for complete search history.

(56) References Cited

U.S. PATENT DOCUMENTS

| | | | | |
|---|---|---|---|---|
| 3,968,845 | A * | 7/1976 | Chaffin | E21B 21/00 175/206 |
| 4,515,229 | A * | 5/1985 | Drummond | E21B 10/18 175/337 |
| 4,516,633 | A * | 5/1985 | Richardson | E21B 17/10 175/213 |
| 2005/0103527 | A1* | 5/2005 | Church | E21B 7/068 175/62 |
| 2008/0236809 | A1* | 10/2008 | Livingstone | E21B 21/12 166/60 |
| 2010/0147591 | A1* | 6/2010 | Pomerleau | E21B 21/08 175/61 |

FOREIGN PATENT DOCUMENTS

| | | |
|---|---|---|
| CN | 89204605 | 4/1989 |
| CN | 1356451 | 1/2002 |
| CN | 101929309 | 8/2010 |
| CN | 1051134114 | 10/2010 |

(Continued)

OTHER PUBLICATIONS

Rueben L Graham, John M. Foster, Paul C. Amick, J. Stanley Shaw, Reverse Circulation Air Drilling Can Reduce Well Bore Damage, Oil & Gas Journal, vol. 91, Issue 12, US, 6 pages.

(Continued)

*Primary Examiner* — Andrew Sue-ako

(74) *Attorney, Agent, or Firm* — David A. Burge

(57) ABSTRACT

A technique for drilling oil, gas and disposal wells in the earth includes drilling a surface hole with by delivering air down one flow path in a drill string and circulating air and drill cuttings up another flow path in the drill string. Surface pipe is cemented in the surface hole and a well bore is drilled below surface pipe.

20 Claims, 2 Drawing Sheets

(56) References Cited

FOREIGN PATENT DOCUMENTS

| | | |
|---|---|---|
| CN | 102268963 | 6/2011 |
| CN | 202560133 | 4/2012 |
| CN | 203066883 | 1/2013 |
| CN | 103397847 | 7/2013 |
| CN | 203515345 | 9/2013 |
| CN | 104632112 | 11/2013 |
| CN | 103939016 | 5/2014 |
| CN | 203835257 | 5/2014 |
| CN | 204283212 | 12/2014 |
| CN | 204419036 | 1/2015 |
| CN | 104832082 | 2/2015 |
| CN | 105113978 | 6/2015 |
| CN | 204920823 | 6/2015 |
| CN | 204782871 | 7/2015 |
| CN | 105178859 | 10/2015 |
| CN | 105178897 | 10/2015 |
| CN | 205036295 | 10/2015 |
| CN | 205036331 | 10/2015 |
| CN | 105696959 | 1/2016 |
| CN | 106093338 | 7/2016 |

OTHER PUBLICATIONS

Large Diameter Reverse Circulation, Matrix Drilling Products, 7 pages.
John L'Espoir, Transfer of Technology, No. 22 of 30, Water Well Journal, Nov. 2010, pp. 54-69.
John L'Espoir, Chapter 22, Reverse Drilling, pp. 147-156.
Numa Hammers, company publication, 9 pages.

* cited by examiner

Fig.1
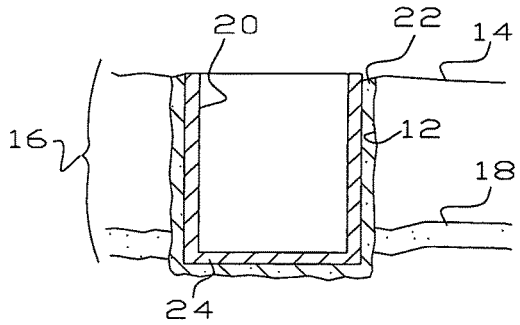
Fig.2
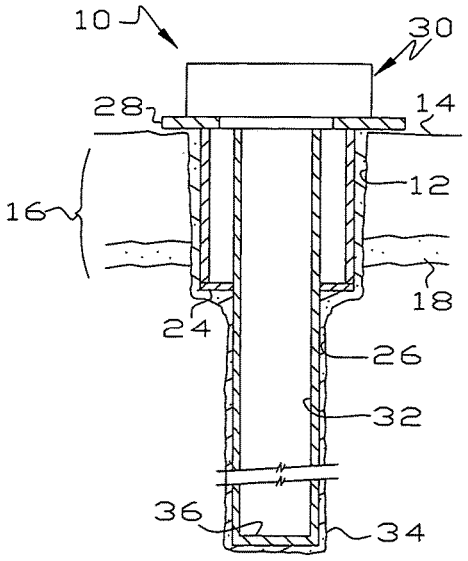
Fig.3
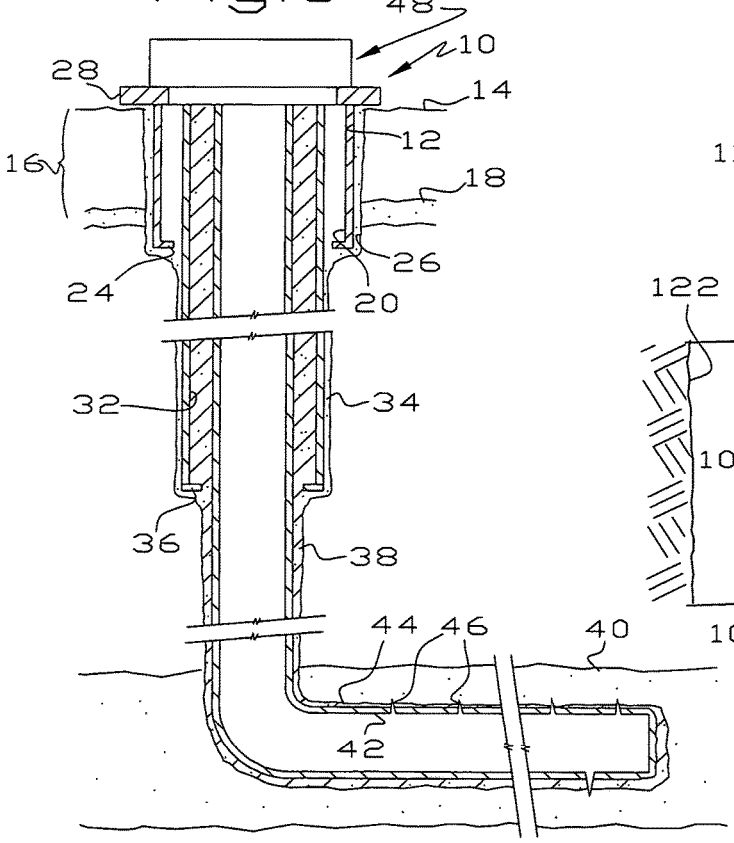
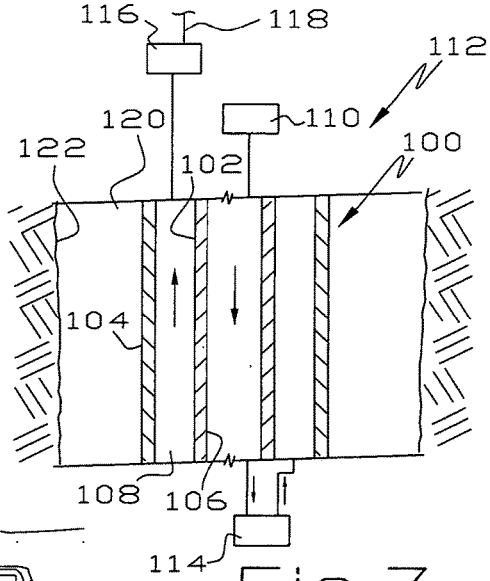
Fig.7

DRILLING WELLS WITH AIR

REFERENCE TO PROVISIONAL APPLICATION

This utility application claims the benefit of the Feb. 4, 2017 filing date of Provisional Application Ser. No. 62/499,713 entitled Drilling Wells With Air, filed by Jason A. Hatfield, the disclosure of which is incorporated herein by reference.

This invention relates to a technique for drilling oil, gas and disposal wells with air.

BACKGROUND OF THE INVENTION

In the drilling of oil, gas and disposal wells, the first part of the hole drilled into the earth is typically through a section where fresh water formations are exposed in the well bore. It is typically necessary to cement a string of surface pipe through any fresh water section in order to protect fresh water aquifers from contamination from drilling fluids and reduce problems that would otherwise occur later in the drilling operation if there were no surface pipe.

In areas where many highly prolific aquifers below surface pipe are encountered, drilling below surface pipe is accompanied by the circulation of drilling mud through the well bore. An ancillary benefit of surface pipe, in mud drilling, is to seal off unconsolidated formations which might take drilling mud and thereby create a blow out hazard. In other areas, typically where there are fewer aquifers below surface pipe and where the drilled formations are hard, such as limestones, dolomites, hard shales and thoroughly cemented sandstones, drilling is accompanied by the circulation of air through the well bore. Air drilling is much preferred in these areas primarily because of relatively high penetration rates and secondarily because of the ease of evaluating permeable formations for oil or gas. Accordingly, drilling with mud is widespread in the Gulf Coast, in the Gulf of Mexico and much of the mid-continent while air drilling is much preferred in Appalachia and areas of West Texas and other hard rock areas.

A major difficulty in air drilling is contending with the influx of water from permeable formations. There are essentially two solutions: increasing the rate of air flow through the drill string or adding soap to the air stream and thereby changing from straight air to foam, or some combination of more air and foam. It may accordingly be difficult, impractical or overly expensive under some circumstances to drill the surface hole with air because one is inherently contending with permeable aquifers that give up significant amounts of water. Thus, in air drilling country, it is often most efficient to drill the surface hole of an oil, gas or disposal well with mud, cement a string of surface pipe in the well bore and then convert to air drilling below surface pipe. This is not inexpensive but, all things considered, is the most efficient current approach under many circumstances. The alternative is to drill the surface hole with air and have enough air compressor capacity and/or foam capacity to keep the well bore unloaded regardless of the amount of water produced from near surface aquifers.

The problem of contending with produced water is made worse when it is necessary or desirable to drill surface holes that are large when compared to the O.D. of the drill string. The reason is the annulus between the well bore and the drill string is large and the rate of air flow is not sufficient to keep water droplets moving upwardly in the annulus. In these situations, the droplets coalesce and the upward air velocity is insufficient to keep the annulus unloaded with reasonable air flows thereby requiring the addition of surfactant to the air stream to generate foam.

One situation where it is necessary to drill large diameter surface holes is in the drilling of relatively deep wells which require running strings of large diameter surface casing in order to reach total depth with a well bore of sufficient diameter to accommodate a conventionally sized production string. One area where conditions dictate the drilling of large diameter surface holes in hard rock country is drilling wells to produce from the Marcellus or Utica shales in the northeastern United States. A similar set of circumstances exists in some areas of West Texas and New Mexico. Those skilled in the art will recognize that these conditions occur in many other locales.

In hard rock areas of this type, one occasionally encounters fractures, even in rocks near earth's surface. It has occurred in the past that drilling a large diameter surface hole with air and foam has intersected a fracture in a fresh water aquifer of a thoroughly cemented sandstone. This has resulted in delivering a large amount of soapy water into the fracture. The aquifer may be contaminated in very short order because of the high conductivity of the fracture. Because it is very difficult or impossible to predict the existence of near surface fractures in the intended path of a well bore, surprises of serious complications can occur in drilling surface holes with air and soap.

Standard air drilling is sometimes called direct air drilling where air is delivered downwardly through the drill string, out through the bit or hammer and then upwardly in the annulus between the drill string and the wall of the well bore. This is the technique that is universally used in the United States to drill oil, gas and disposal wells of any depth with air.

Reverse air drilling is also known where the drill string includes inner and outer concentric pipe strings, air is delivered downwardly through the annulus between the pipe strings, through the bit and then upwardly through the inner pipe string. Reverse air drilling is typically used in the United States to explore for expensive minerals where the goal is to recover all of the drill cuttings without contamination by well bore debris or without contact between drill cuttings and the wall of the well bore. A discussion of mud and air reverse drilling is found in Chapter 22 of The Transfer of Technology and in a publication of similar name by John L'Espoir published in Water Well Journal of November 2010.

SUMMARY OF THE INVENTION

The broad concept of this invention is to use reverse air drilling or a disclosed alternative to drill the surface hole of an oil, gas or disposal well through a fresh water interval and then cement a string of surface pipe in the surface hole. The well may be deepened below surface pipe in any suitable manner and may preferably be done by direct air drilling below the fresh water zone. It may be preferred, during reverse air drilling of the surface hole, to inject potable or fresh water along with the air.

A major advantage of reverse air drilling, or the disclosed alternative, is there is little or no chance of contaminating fresh water aquifers when drilling the surface hole. Because most surface holes can be drilled without the addition of soap, an ancillary advantage is the ease of disposing of produced water. Disposing of potable water is much easier and much less expensive than disposing of a like volume of soapy water.

BRIEF DESCRIPTION OF THE DRAWINGS

FIGS. 1-3 are cross-sectional views of a typical oil, gas or disposal well in several stages of being drilled into the earth;

FIG. 7 is a schematic view similar to FIG. 5 illustrating an alternate approach to reverse air drilling.

DETAILED DESCRIPTION OF THE INVENTION

Figure 5:
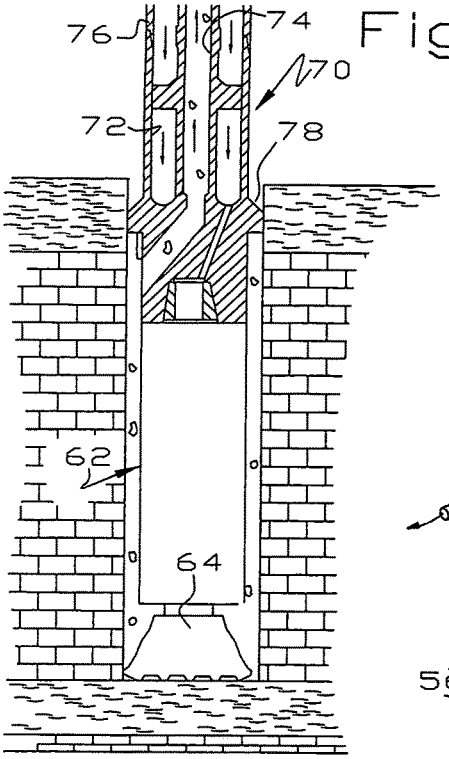
FIG. 5 is a cross-sectional view of one type of reverse air drilling equipment.

As used herein, the term air drilling includes drilling a bore hole in the earth while circulating through the drill string only air, circulating a mixture of air and water, circulating a mixture of air, water and one or more suitable chemicals, circulating a mixture of air, water and surfactant and circulating a mixture of air and surfactant.

Referring to FIGS. 1-3, an oil, gas or disposal well 10 is illustrated as having a vertical surface hole 12 drilled from adjacent earth's surface 14 through a near surface section 16 containing at least one fresh water aquifer 18 in which surface pipe 20 has been set by a sheath of cement 22. The depth of the surface hole 12 is almost always sufficient to penetrate the deepest fresh water aquifer and is typically dictated by state regulatory bodies to protect fresh water aquifers from damage during drilling of the well 10. Typically, the surface hole 12 starts at earth's surface 14 although, on occasion, conductor pipe (not shown) is driven or implanted in surface formations which are so soft as to wash out in normal drilling operations so drilling may start in the vicinity of or adjacent earth's surface, i.e. at earth's surface, in conductor pipe or at the bottom of conductor pipe. Conductor pipe may be driven into the earth or drilled and cemented in place. The purpose of conductor pipe is to provide a return path for mud while drilling the surface hole, often in areas where return mud flowing in a ditch will present environmental difficulties, such as offshore, in marshy areas, in sandy areas and other situations known to those skilled in the art. Usually, there is only a joint or two of conductor pipe and the bottom of conductor pipe is substantially above fresh water aquifers to be exposed in the surface hole. In the industry, there is no confusion about what is conductor pipe and what is surface pipe. Typical cementing operations use a float shoe 24 and other float equipment (not shown) on the bottom of the surface pipe 20 to conduct cementing operations to pump cement into the annulus between the surface pipe 20 and the surface hole 12 as will be apparent to those skilled in the art.

FIG. 2 illustrates a situation where an intermediate hole section 26 is drilled. Before beginning drilling the intermediate hole section 26, conventional operations are conducted such as attaching a bradenhead or casing head 28 to the uppermost joint of surface pipe 20 and attaching a blow out preventer 30 to the bradenhead or casing head 28. The blow out preventer 30 controls pressure emitting from the well 10 in an effort to prevent uncontrolled flowing of reservoir fluids to the surface. The bradenhead 28 is typically at ground level although it may be in a cellar (not shown) below ground level. Those skilled in the art will recognize the bradenhead 28 and blow out preventer 30 to be conventional equipment available from a number of oil field suppliers.

The intermediate hole section 26 may be drilled vertically through the float shoe 24 and a string of pipe 32 run from earth's surface 14 to the bottom of the intermediate hole 26 and set by a sheath of cement 34. Suitable float equipment 36 on the bottom of the protection pipe 32 facilitates pumping cement into the annulus between the pipe 32 and the intermediate hole section 26. In some situations, the pipe 32 is protection pipe to allow safe drilling to deeper horizons. In some situations, the pipe 32 is production pipe penetrating a hydrocarbon bearing formation which is perforated to induce contents of the hydrocarbon bearing formation to flow to earth's surface.

FIG. 3 shows another section 38 of hole has been drilled through the float equipment 36 into a desirable formation 40, such as an oil or gas bearing formation, in the case of either a vertical well (not shown) or a horizontal well, as illustrated. A string of production casing 42 is cemented in the hole section 38 by a cement sheath 44. Conventional completion steps may be taken to modify the well 10 to produce the contents of the formation 40 to earth's surface such as by creating perforations 46 in the production casing 42, setting a Christmas tree or valve assembly 48 on the casing head 28 and conducting other necessary or desirable operations such as fracing the formation 40 and thereby allowing or inducing the contents of the formation 40 to flow to earth's surface as will be understood by those skilled in the art. In the alternative, liquids may be disposed of by injecting them into the formation 40 through perforations 46. Those skilled in the art will recognize the well 10 as being typical of deep modern wells having a horizontal leg. Those skilled in the art will also recognize that the depth of surface pipe, depth or existence of protection pipe, length of a vertical section of hole and length and/or presence of a horizontal well section depends on the location of the well 10, the intended target of the well 10, the intended use of the well 10 and other factors. Above ground equipment, such as risers, valve assemblies and other conventional equipment attached to one or more of the pipe strings 20, 32, 42 has been omitted for clarity of illustration.

Figure 4:
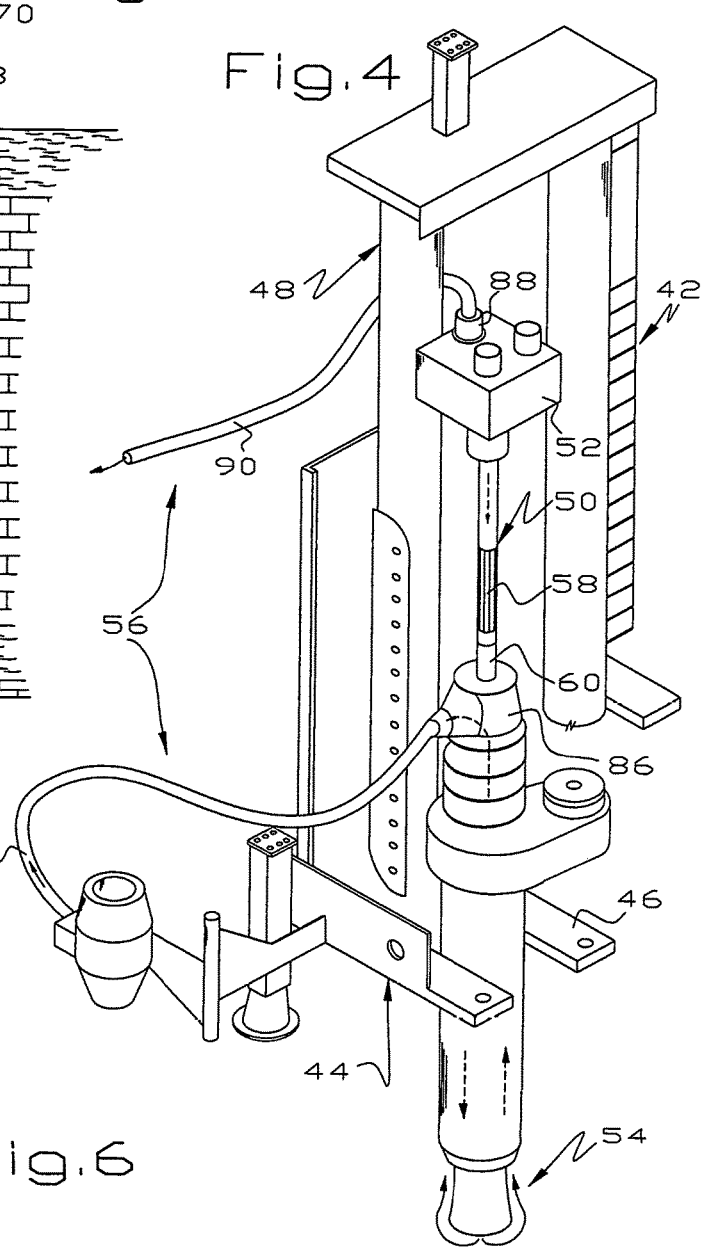
FIG. 4 is a view, largely schematic, of a drilling rig used in drilling of wells with air.
Figure 6:
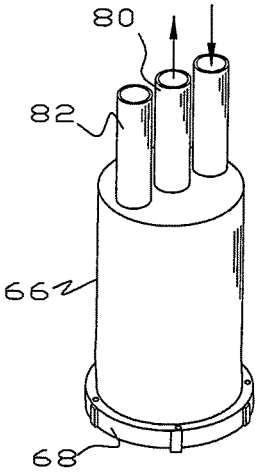
FIG. 6 is a view of another type reverse air drilling equipment.

The surface hole 12 in particular and/or the intermediate hole 26 and hole section 34 may be drilled with an air drilling rig 50, one type being partially shown in FIG. 4. The rig 50 may include a substructure 52, a floor (not shown), a derrick 54, suitable equipment (not shown) for raising and lowering a drill string 56, pipe handling equipment (not shown), a top drive 58 for rotating the drill string 56 and drilling assembly 60 and air handling equipment 62 and the like. The drill string 56 may be of the concentric pipe type having inner and outer generally concentric conduits 64, 66. Dual concentric string drill pipe is commercially available from suppliers such as Matrix Drilling Products of Lewisburg, Tenn. The individual components of the rig 50 are conventional and reference is made to manufacturers of such equipment for a more complete description. The drill string 56 may comprise a series of threadably connected joints having integral inner and outer conduits 64, 66 and one or more drill collars immediately above the drilling assembly 60. The drilling assembly 60 may be a roller cone bit 68 as shown in FIG. 4, a hammer 70 and bit 72 or hammer 74 and bit 76, as shown in FIGS. 5 and 6 or any other suitable device. There are two varieties of hammers 70, 74 used in reverse air drilling. The hammer 70 is of the direct air circulation type but uses an interchange sub 78 to direct air downwardly through an annulus 80 between inner and outer conduits 82, 84 to convert the conventional hammer 70 into a reverse air hammer. The interchange sub 78 may include a seal, shoulder or packer 86 to restrict flow between the wall of the bore hole and the body of the crossover sub 78 to direct air and cuttings flow upwardly through the inner conduit 82. The hammer 74 is manufactured to be a hammer incorporating reverse air flow, i.e. downwardly in an annulus represented by the conduit 90 in FIG. 6 between inner and outer conduits and upwardly in the inner conduit 88. Both type hammers are commercially available from Numa Hammers, 646 Thompson Road, Thompson, Conn.

FIG. 4 shows one version of substantially conventional air handling equipment 62 which may include suitable compressors (not shown) delivering high pressure air into an inlet conduit 92, a swivel 94 delivering air from the conduit 92 to the annulus between the inner and outer conduits 64, 66, a swivel 96 allowing rotation of the drill string 56 while delivering return air and cuttings to a return hose 98. Other air handling configurations are also well know in the art where the swivels 94, 96 are of somewhat different internal configuration so air circulation is in through the conduit 98 and out through the conduit 92 as discussed more fully hereinafter in conjunction with FIG. 7. Air and cuttings from the inner conduit 64 may pass to a cyclone, other dust handling facility (not shown) or simply exhaust into the atmosphere in a manner known to those skilled in the art.

There are many surface holes that can be drilled in hard rock country using conventional direct air drilling with or without the addition of soap or drilling the surface hole with mud. This has been the standard in the United States for at least a century. These conditions exist when the diameter of the surface hole is small relative to the O.D. of the drill string or when the use of soap is unobjectionable. Drilling a surface hole 12 with reverse air drilling has particular advantage when the cross-sectional area of the hole 12 is large compared to the cross-section of the O.D. of the drill string 56. This may be shown by the following examples.

EXAMPLE 1

Drilling Small Diameter Surface Hole with Direct Circulation

In drilling a conventional relatively shallow oil, gas or disposal well, it is common to drill a 10¾" surface hole with a tricone roller bit using direct air circulation and set 8⅝" surface pipe using drill pipe of 3½" O.D. The cross-sectional area of the annulus between the drilled hole and the O.D. of the drill string is about 91 square inches−10 square inches or about 81 square inches. The ratio between the annulus area and the outer cross-sectional area of the drill pipe is accordingly about 9. The important factor keeping water moving upwardly in the annulus is the upward velocity of the air. If 1500 standard cubic feet/minute of air at 250 psig is delivered to the tricone bit, the pressure exhausting from the bit is estimated to be at about 75 psig. Correcting for pressure, this means that the actual volume of air exiting the hammer is about 1500×15/90=250 cubic feet/minute or about 4 cubic feet per second, assuming no correction for temperature. The upward velocity of air near the bottom of the surface hole would be: 4 cubic feet/second divided by 81/144 equals about 7 feet per second. This is may be too low to move water upwardly in the annulus between the well bore and the O.D. of the drill string, meaning that one would have to increase the volume of air or add soap to the air to produce foam and thereby increase the carrying capacity of air in the annulus. Because air in the annulus expands during upward movement, upward velocity in the annulus increases toward the surface. Thus, the critical area for low velocities that tend to accumulate water in the well bore is near the bottom of the hole.

EXAMPLE 2

Drilling Large Diameter Surface Hole with Direct Circulation

Drilling a large diameter surface hole is an order of magnitude different than Example 1. Large diameter surface holes are necessary when beginning to drill a deep well which requires a bore hole diameter at total depth sufficient to accept a conventionally sized production string, which is currently 4½" O.D., 5" O.D. liner or 5½" O.D. but which may change over time. The deepest part of a deep oil or gas well is currently typically drilled with direct circulation air or mud and a conventional drill string using a series of drill collars and either a tricone or PDC bit of sufficient size to receive 4½", 5" or 5½" O.D. casing, meaning that the intermediate hole 26 is typically 13" and the protection string 42 is typically 10¾" O.D. and the surface pipe 20 is typically 16" O.D., meaning the surface hole 12 is at least 20". Twenty four inch diameter surface holes are common. Drilling a large diameter surface hole with direct air circulation might use a drill string 56 of 5½" O.D. drill pipe. The cross-sectional area of the annulus between a 20" diameter drilled hole 12 and the O.D. of the drill string 56 is about 314 square inches−24 square inches or about 290 square inches. The ratio between the annulus area and the outer cross-section of the drill pipe may accordingly about 13 in a 20" surface hole and about 18 in a 24" surface hole. The important factor keeping water moving upwardly in the annulus is the upward velocity of the air near the bottom of the drilled hole. If 6000 standard cubic feet/minute of air at 300 psig is delivered to a direct circulation air hammer, and if the exhaust pressure from the hammer is on the order of 75 psig, correcting for pressure, this means that the actual volume of air exiting the hammer is about 6000×15/90=1000 cubic feet/minute or about 17 cubic feet per second, assuming no correction for temperature. The upward velocity of air near the bottom of the surface hole would be: 17 cubic feet/second divided by 290/144 square feet or about 8.5 feet per second which is too low to keep the well bore unloaded so the well fills up with water and air drilling essentially stops. In such circumstances, the normal solution is to add soap to the circulating air to create foam which has a larger water carrying capacity than only air.

EXAMPLE 3

Drilling Large Diameter Surface Hole with Reverse Air Circulation

When drilling a 20" surface hole with reverse air circulation, a typical drill string 56 may include a 7" O.D. outer conduit 66 and a 4" O.D. inner conduit 64 having an I.D. of about 3½". The cross-sectional area of the inside of the inner conduit 64 is about 10 square inches. The ratio between the annulus area and the outer cross-section of the drill pipe is accordingly about 8 with a 20" diameter surface hole and about 12 with a 24" diameter surface hole. The important factor keeping water moving upwardly inside the inner conduit 64 is the upward velocity of the air. If 3500 standard cubic feet/minute of air at 300 psig is delivered to a reverse circulation air hammer, and if the exhaust pressure from the hammer is on the order of 75 psig, correcting for pressure, this means the actual volume of air exiting the hammer is about 3500×15/90=about 580 cubic feet/minute or almost 10 cubic feet per second, assuming no correction for temperature. The upward velocity of air near the bottom of the surface hole would be: 10 cubic feet/second divided by 10/144 square feet or about 144 feet per second or about sixteen times the upward velocity of drilling the same surface hole with direct air circulation, using a 20" diameter surface hole as an example but using much less air than in drilling with direct circulation. In reverse drilling, the controlling factor in determining the amount of air needed is that sufficient to run the hammer 70 or 74 rather than an amount of air needed to circulate drill cuttings and water to the surface. In this example, the upward velocity in the drill string is much higher than is necessary to keep water flowing upwardly inside the inner conduit 64, meaning that no soap is necessary to keep the well bore unloaded. There is so much capacity to handle produced water, it may be desirable, before encountering an aquifer, to inject water into the air inlet conduit 92 in order to suppress dust exiting from the return hose 98 and to minimize or prevent the formation of mud rings on the inside of the well bore 12 which reduce the I.D. of the surface hole 12 and create complications when running surface pipe 20.

In direct air drilling, the amount of air necessary is dictated by the volume sufficient to keep cuttings flowing upwardly in the annulus. This is typically much higher than in reverse air drilling where the amount of air necessary is dictated by the volume sufficient to operate the hammer. This is illustrated by a comparison of Examples 2 and 3 where the volume of air is much reduced in Example 3.

It will accordingly be seen that, in the examples used, reverse air circulation drilling of a large surface hole produces upward velocity of air, cuttings and any produced water many times greater than direct air circulation while using less air and thereby reduce costs associated with running high volume air compressors. The exact improvement is a function of the size of the surface hole, i.e. the larger the surface hole, the greater the improvement. It will be apparent that reverse air drilling of surface holes is desirable when the ratio of the area of the annulus between the well bore and the drill string is at least seven. Although there is essentially no upper limit where reverse air drilling loses its advantage, a preferred range may be between seven and thirty.

After the surface hole 12 is drilled, the drill string 50 is removed from the well, a string of surface pipe 20 is run into the surface hole 12 and cemented in place, typically by pumping cement down the surface pipe 20, through the float shoe 24 and upwardly in the annulus between the surface pipe 20 and the well bore 12. After surface pipe 20 has been cemented in place, the bradenhead 28 and the blow out preventer 30 are installed and conditions may suggest drilling the intermediate hole 26 and setting a string of production pipe 42. Although the intermediate hole 26 may be drilled with reverse air circulation or with mud, it may be preferred to drill all or part of the intermediate hole 26 with direct air circulation. Drilling with direct air circulation is more efficient in the sense that standard drill pipe does not include a thin walled inner conduit which is subject to erosion by drill cuttings. In addition, with direct air circulation, a rig does not require a swivel for exhaust air which is subject to considerably erosion by rapidly moving drill cuttings turning into the return hose.

As is customarily used in air drilling, reverse air circulation means air is delivered down the annulus between the inner and outer walls of the drill pipe and the central passage of the inner drill pipe. Referring to FIG. 7, there is schematically illustrated a different approach that works effectively. A drill string 100 includes inner and outer tubes 102, 104, which may be concentric or non-concentric, providing a central passage 106 and an annulus 108. High pressure air is delivered downwardly into the central passage 106 of the drill string 100 through a suitable swivel 110 comprising part of an air drilling rig 112.

Air exits from the inner tube 102 into an roller bit or air hammer 114 and then passes upwardly through the annulus 108 through a swivel 116 and exhaust hose 118 for conventional handling. Because the annulus 108 is areally much smaller than the annulus 120 between the outside of the drill string 100 and the inside of a well bore 122, the same advantages accrue when compared to reverse air drilling. The embodiment of FIG. 7 resembles direct air drilling except that upward air flow is in the annulus 108 between the inner and outer pipe strings 102, 104 rather than in the annulus 120 between the outside of the drill string 100 and the wall of the well bore 122. It will be apparent that the drill string 100 can comprise an outside conduit and two or more parallel non-concentric inside conduits providing multiple flow paths between earth's surface and the bottom of the well bore 112. The drilling rig 112 includes other conventional equipment, analogous to that shown in FIG. 4, to operate as an air drilling rig.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A method of drilling oil, gas and disposal wells including selecting a location for a hole in an area of earth's surface free of a bore hole having casing therein;

providing a drill string having an outer dimension and at least two flow paths, integral to each other and being inside the outer dimension, the flow paths extending from earth's surface to a drilling assembly on a lower end of the drill string, the drilling assembly being configured to drill a hole of a predetermined diameter, drilling the hole in the area free of a cased bore hole with a diameter of at least 20 inches from earth's surface through an interval including at least one fresh water aquifer with the drill string and drilling assembly by delivering air down one of the flow paths and up another of the flow paths;

the amount of air delivered downwardly being sufficient to produce an upward velocity in the another flow path greater than necessary to keep water moving in the another flow path, then cementing pipe in the hole; and drilling a well bore into an earth formation below the pipe string.

2. The method of claim 1 wherein drilling comprises drilling the hole of sufficient size wherein the ratio of the areas of an annulus between the hole and the drill string to that of the drill string is at least seven.

3. The method of claim 2 wherein drilling comprises drilling the hole of sufficient size wherein the ratio of the areas of the annulus between the hole and the drill string to that of the drill string is in the range of 7-30.

4. The method of claim 1 further comprising cementing a string of protection pipe in the well bore and then drilling a hole section into an earth formation below the protection pipe.

5. The method of claim 4 further comprising cementing a string of pipe in the hole section below protection pipe.

6. The method of claim 5 further comprising completing the well and producing formation contents to earth's surface.

7. The method of claim 1 further comprising, before intersecting an aquifer, adding water to the air delivered downwardly and thereby suppressing dust.

8. The method of claim 1 wherein the hole is twenty four inches in diameter.

9. A method of drilling oil, gas or disposal wells including selecting a location for a hole in an area of earth's surface free of a bore hole having casing therein;

providing a drill string having an outer dimension and at least two flow paths, integral to each other and being inside the outer dimension, extending from earth's surface to a drilling assembly including an air operated hammer on a lower end of the drill string, the hammer being configured to drill a hole of a predetermined diameter, the hammer being configured to require a predetermined minimum quantity of air to operate, there being a predetermined minimum amount of air sufficient to run the hammer;

drilling the hole inside the area free of a cased bore hole with a diameter of at least twenty inches from earth's surface through an interval including at least one fresh water aquifer with the drill string and drilling assembly and thereby creating a hole annulus of predetermined size between the hole and the drill string, the hole drilling including lowering the drill string and the two flow paths together into the hole as the hammer drills the hole, delivering air downwardly through one of the flow paths in a quantity sufficient to operate the hammer and delivering air and drilled cuttings upwardly through another of the flow paths, the amount of air delivered downwardly being sufficient to produce an upward velocity in the another flow path greater than necessary to keep water moving in the another flow path, the predetermined minimum quantity of air necessary to operate the hammer produces an upward velocity in the another flow path greater than necessary to keep water moving in the another flow path, then cementing a string of pipe in the hole; and drilling a well bore into earth formations below the pipe string.

10. The method of claim 9 wherein the drill string includes a first pipe string inside a second pipe string, the first pipe string providing a central passage, there being an annulus between the pipe strings, downward air delivery comprising delivering the quantity of air downwardly through the annulus and upward air delivery comprising delivering air and drilled cuttings upwardly through the central passage.

11. The method of claim 9 wherein the drill string includes a first pipe string inside a second pipe string, the first pipe string providing a central passage, there being an annulus between the pipe strings, downward air delivery comprising delivering the quantity of air downwardly through the central passage and upward air delivery comprising delivering air and drilled cuttings upwardly through the annulus between the pipe strings.

12. The method of claim 9 wherein drilling comprises drilling the hole of sufficient size wherein the ratio of the areas of an annulus between the hole and the drill string to that of the drill string is at least seven.

13. The method of claim 9 wherein drilling comprises drilling the hole of sufficient size wherein the ratio of the areas of an annulus between the hole and the drill string to that of the drill string is in the range of 7-30.

14. The method of claim 9 further comprising securing a casing head and blow out preventer to the pipe, drilling a well bore below the pipe, cementing a string of protection pipe in the well bore and then drilling another hole section below the protection pipe intersecting a hydrocarbon bearing formation.

15. The method of claim 14 further comprising cementing a string of production pipe in the another hole section.

16. The method of claim 15 further comprising perforating the production pipe and inducing contents of the hydrocarbon bearing formation to flow to earth's surface.

17. The method of claim 9 wherein the well bore intersects a hydrocarbon bearing formation and further comprising cementing a string of production pipe in the well bore, perforating the production pipe in the hydrocarbon bearing formation and inducing flow of contents of the hydrocarbon bearing formation to earth's surface.

18. The method of claim 9 further comprising, before intersecting an aquifer, adding water to the air delivered downwardly and thereby suppressing dust.

19. The method of claim 9 wherein the hole is twenty four inches in diameter.

20. A method of drilling oil, gas or disposal wells including selecting a location for a hole in an area of earth's surface free of a bore hole having casing therein;

providing a drill string having an outer dimension and at least two flow paths, integral to each other and inside the outer dimension, extending from earth's surface to a drilling assembly on a lower end of the drill string, the drilling assembly including an air operated hammer configured to drill a hole of a predetermined diameter, the hammer being configured to require a predetermined minimum quantity of air to operate, there being a predetermined minimum amount of air sufficient to run the hammer;

drilling a hole in the area free of a cased bore hole with a diameter of at least twenty inches from proximate earth's surface through an interval including at least one fresh water aquifer with the drill string and drilling assembly and thereby creating a hole annulus of predetermined size between the hole and the drill string, the hole drilling including lowering the drill string and the two flow paths together into the hole as the drilling assembly drills the hole, delivering air downwardly through one of the flow paths in an amount sufficient to operate the hammer and delivering air and drilled cuttings upwardly through another of the flow paths, the predetermined minimum quantity of air delivered downwardly being sufficient to produce an upward velocity in the another flow path greater than necessary to keep water moving in the another flow path, adding water to the air delivered downwardly before intersecting an aquifer and thereby suppressing dust; then cementing a string of pipe in the hole; and drilling a well bore into earth formations below the pipe string.

* * * * *